US005931439A

United States Patent [19]

Lemire

[11] Patent Number: 5,931,439

[45] Date of Patent: Aug. 3, 1999

[54] FRAME SUPPORT

[76] Inventor: Robert Lemire, 21 Carriage Dr., Kings Park, N.Y. 11754

[21] Appl. No.: 08/816,912

[22] Filed: Mar. 13, 1997

[51] Int. Cl.[6] ..... A47G 1/16; A47G 1/24

[52] U.S. Cl. ..... 248/493; 248/476; 248/495

[58] Field of Search ..... 248/493, 476, 248/489, 495, 498

[56] References Cited

U.S. PATENT DOCUMENTS

| | | | |
|---|---|---|---|
| 351,673 | 10/1886 | Vosburgh . | |
| 994,511 | 6/1911 | Gross . | |
| 1,057,484 | 4/1913 | Huber . | |
| 2,496,990 | 2/1950 | Downing | 248/29 |
| 2,697,572 | 12/1954 | Pfankuch | 248/31 |
| 3,251,569 | 5/1966 | Rynearson | 248/31 |
| 3,676,944 | 7/1972 | Eubank, Jr. | 40/155 |
| 4,162,056 | 7/1979 | Moorhead | 248/495 |
| 4,364,538 | 12/1982 | Tomlinson | 248/495 |
| 4,566,665 | 1/1986 | Rynearson | 248/495 |
| 4,892,284 | 1/1990 | Kelrick | 248/476 |
| 5,365,682 | 11/1994 | Eubank, Jr. | 40/152.1 |
| 5,806,826 | 9/1998 | Lemire | 248/476 |

*Primary Examiner*—Ramon O. Ramirez

*Assistant Examiner*—Anita M. King

*Attorney, Agent, or Firm*—Proskauer Rose LLP

[57] ABSTRACT

An improved frame support permits an object being hung to be moved up and down, side to side, and/or rotated in any desired orientation and which provides improved security and safety from intentional or accidental removal from the wall. The invention includes a plate having a set of cord supports directed in a first direction towards a top edge of the plate and at least one cord support directed in a second, opposite direction towards a bottom edge of the plate. The support cord is supported by the frame and by the frame support in a unique manner which provides up and down, side to side, and rotational adjustability. The invention also provides increased security for frames supported by the device described herein. In its simplest form, the improved security device according to the present invention may be provided by "locking" the support cord into place on the adjusting hook with a nut. This provides security from removing the picture from the wall, to prevent theft, for example, and to provide added security in case the cord disconnects from one side of the frame. In one version, the support cord is also protected from rubbing against the screw by providing a sheath covering the screw, such as using a spacer or recessed nut. This prevents the cord from fraying or breaking due to the screw "sawing" through the cord over time.

28 Claims, 9 Drawing Sheets

FRAME SUPPORT

FIELD OF THE INVENTION

The present invention relates to a device for supporting a frame or other object on a wall and, more particularly, to an improved frame support which permits an object being hung to be moved up and down, side to side, and/or rotated in any desired orientation and which provides improved security and safety from intentional or accidental removal from the wall.

RELATED APPLICATION

This application includes subject matter related to the subject matter of U.S. patent application Ser. No. 08/630,878 filed on Apr. 2, 1996 and entitled IMPROVED PICTURE FRAME HANGER to Robert Lemire, the applicant herein. The contents of that application are incorporated herein by reference.

BACKGROUND OF THE INVENTION

Objects such as framed art work, mirrors, photographs, diplomas, and the like are typically hung on a wall by hammering one or two nails or hooks into the wall, and supporting the picture on the nail(s) or hook(s) by a support wire or string attached to the object. If a single nail or hook is used, the object may tilt due to non-uniform weight distribution, vibrations, persons bumping into it, and other reasons. Using two nails or hooks provides additional stability.

Conventionally, hanging an object at a desired height and/or location is not as simple as just hammering the hooks into the wall. To hang the object at a desired height, the hooks must be properly positioned with respect to the wire. This height must take into consideration where the support wire is connected to the sides of the object, how far the object drops when the wire is hung on the hooks, and how far apart the hooks are from each other.

With either the one or two nail or hook arrangement, once nailed into the wall, adjusting the height or side-to-side position of the object is difficult. Either the support wire must be shortened (to change the height) or the hooks or nails must be nailed into a new location in the wall (to change the height and/or the side-to-side location). This has several drawbacks. First, it is time consuming; one may have to re-measure the hooks to make sure that they are at the proper height and proper distance apart. Second, it requires a second set of holes in the wall—this is particularly undesirable if the first set of holes is visible due to the new location of the object.

After the nail or hooks are affixed in the walls, the wire on the object must be positioned over them. This procedure is difficult, particularly for large objects. This is because it is undesirable for the support wire to show above the object. Thus, the support wire length is selected to be short so as not to extend over the top of the object when pulled up when the object is hanging on the hooks. This short support wire provides little room behind the object to position the support wire into the hooks. This procedure typically must be done "blind", using one's "feel", rather than sight, to position the support wire.

Another disadvantage to the conventional arrangement is that the nail or hook and support wire arrangement does not provide any protection against accident or theft. For example, if the support wire breaks or disconnects from the object, the object will fall and possibly be damaged, not to mention injury or damage that may occur to persons or objects beneath it. A particularly valuable object or art work hanging in publicly assessable areas, such as office buildings, or hotel rooms, is not protected from theft—a thief having access to the object may take it off the wall simply by lifting it off of the hooks or nails.

Yet another disadvantage to conventional picture frame hangers is that the orientation of the picture is limited to being substantially parallel to the plane defined by the points to where the support wire is connected to the frame. For example, if the support wire is connected to two opposite sides of a rectangular frame, the hanged frame will be oriented with a top that is parallel to the plane defined by the support wire's support points in the sides. The frame cannot, if desired, be oriented in any other manner, such as with a corner of the frame pointing up to provide a diamond-shaped orientation. Another reason an unusual orientation may be desirable is where a frame is being hung near a wall or ceiling that is not plumb or level. Often, hanging a frame near such a wall or ceiling emphasizes the defect in the wall or ceiling. It may be preferable in such instances to hang a frame at a slightly angled orientation.

On the other hand, as a practical matter, picture hangers should be economical to manufacture. Most persons do not want to spend more than a few cents to a few dollars on a picture hanger. A typical set of hooks for hanging a picture is quite inexpensive. Thus, even if a picture hanger overcame the drawbacks discussed, it may not be a successful product if it is overly expensive to manufacture. Few, if any, people will buy a picture hanger costing significantly more than a hook, which is relatively inexpensive. Thus, an economical design is an advantageous feature of a picture hanger.

Therefore, it is an object of the present invention to provide a picture frame hanger that permits the object to be hung to have any desired orientation.

It is a further object of the present invention to provide a picture hanger which provides improved security from damage or theft.

It is an even further object of the present invention to provide a picture hanger having an economical design.

SUMMARY OF THE INVENTION

These and other objects of the invention are achieved by the frame support according to the present invention.

A preferred embodiment of the improved frame support according to the present invention includes a plate having a set of cord supports directed in a first direction, such as towards a top edge of the plate, and at least one cord support directed in a second, opposite direction facing away from the first direction, such as towards a bottom edge of the plate. Optionally, a screw and moveable adjusting hook are provided, such as is described in U.S. patent application Ser. No. 08/630,878. If the optional screw and adjusting hook are provided, the plate includes a top and a bottom screw support. The screw extends through the top and bottom screw supports. The adjusting hook has a threaded opening which meshes with the threads. This allows the hook to move up and down along the screw when the screw is turned.

In a preferred embodiment of the present invention, a support cord is movably supported at several locations to a frame or other object to be supported. Preferably, the support cord is supported at four locations, two locations on either side of the frame or object. Preferably, the inventive device may then be connected to the support cord in a novel manner which, when in place, permits the length of support cord between the support points and the cord supports to vary, but the length of support cord between support points on the same side and the length extending through the frame support to remain substantially constant. This arrangement allows the supported frame to be moved up and down, side to side, and/or hung in any desired orientation after the frame support is fixed to the wall, regardless of the location of the cord support connections.

To support a frame or other object according to a preferred method according to the present invention, a frame movably supports a support cord at several locations. The inventive device is connected to the support cord so that the support cord extends from a first side, top support point to a bottom cord support, optionally across the device to an optional adjacent bottom cord support. The support cord then extends up to a second side top, support point, then down to a second side, bottom support point. The support cord then extends up to a second side, top cord support, across the device to the adjacent top cord support (optionally and preferably passing through the adjusting hook), then down to a first side, bottom support point. The cord then extends back to the first side, top support point, where it is connected to the other end of the cord. The support cord may be a continuous loop that is not fixedly connected to any of the support points or the device supports and thus may move through these points. Alternatively, the cord may be fixedly connected either to the top cord supports or to the bottom cord support or supports.

Once the cord is strung through the support points and adjusted to fit the device, the device may then be affixed to a desired location on a wall and the object may be hung from it. In a preferred embodiment, this location need not be precisely measured for height. Preferably, the cord should be tensioned. The cord may be tensioned in a number of ways. For example, the optional moveable adjusting hook may be moved down to apply tension to the support cord. Alternatively, a spring may be provided on the cord to apply tension, or the cord may be precisely measured so that it is tense when connected. This tensioning of the cord allows the object to be placed in a wide range of stable locations. Using the optional adjusting hook, the plate may be affixed to a wall in a manner that the frame hangs below the top of the plate. The frame may then be tensioned by turning the screw until the cord tension is sufficient to support the frame. Once tensioned, because the support cord may move through the support points, cord supports (except those to which it may be fixedly connected), and optional adjusting hook, the frame may be raised and lowered, moved from side to side, or rotated to any desired orientation. Even if the support points are located on the sides of a rectangular frame, the frame may be securely placed in any desired orientation, such as diamond shaped.

The present invention also provides increased security for frames or other objects supported by the device described herein or in U.S. patent application Ser. No. 08/630,878. In its simplest form, the improved security according to the present invention may be provided by "locking" the support cord into place on the adjusting hook with a nut. This provides security from removing the picture from the wall, to prevent theft, for example, and, in certain embodiments, to provide added security in case a support wire disconnects from one side of the frame. In a preferred embodiment, the support cord or wire is also protected from rubbing against the screw by providing a sheath covering the screw, such as using a spacer or recessed nut. This prevents the cord or wire from fraying or breaking due to the screw "sawing" through the cord over time.

Each of these embodiments is economical to manufacture and easy to use.

BRIEF DESCRIPTION OF THE DRAWINGS

The present invention is described with reference to the following figures.

DETAILED DESCRIPTION OF PREFERRED EMBODIMENTS

This patent application is divided into two sections. The first section describes an improved frame support which permits up and down, side to side, and rotatable adjustment. This first section is described with respect to FIGS. 1–7. The second section describes an improved security measure for a preferred embodiment of the frame support described herein and the improved picture hanger described in U.S. patent application Ser. No. 08/630,878. This second section is described with reference to FIGS. 8–10.

Improved Frame Support

Overview of the Improved Frame Support

Figure 1:
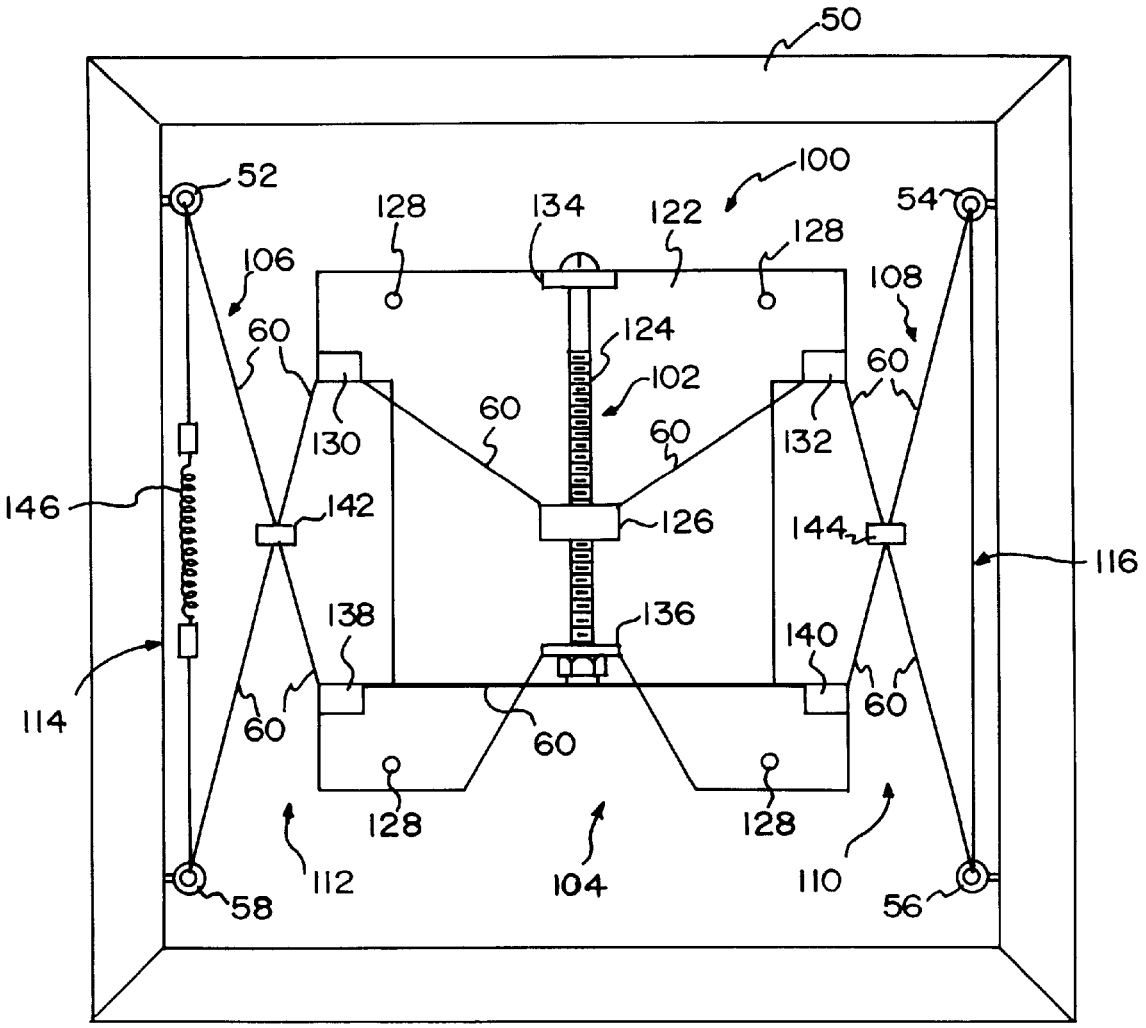
FIG. 1 is a front view of a first embodiment of a frame support according to the present invention connected to a frame or object to be hung.

FIG. 1 is a front elevational view of a frame support 100 according to a preferred embodiment of the present invention connected to a frame 50 or other object which it is supporting. As seen in FIG. 1, a support cord 60 is supported by the frame 50 at a number of points, such as the four eyelets 52, 54, 56, 58. Note that in this embodiment, the support cord 60 is threaded through these support points and is not fixedly connected to any of them. The support cord 60 is also threaded through (but not fixedly connected to) the frame support 100 (at locations 102, 104). The support cord is connected to the support points 52–58 and frame support 100 in a manner so that the length of the support cord between the support points and the frame support (at locations 106, 108, 110, 112) may vary, depending on the orientation of the frame 50, but the length of the support cord 60 across the frame support 100 (locations 102, 104) and between support points 52, 54, 56, 58 (locations 114, 116) remains constant. As described below, this arrangement permits the frame 50 to be moved up and down, side to side, and/or rotated and maintained at any desired orientation.

Structure of the Improved Frame Support

Figure 2:
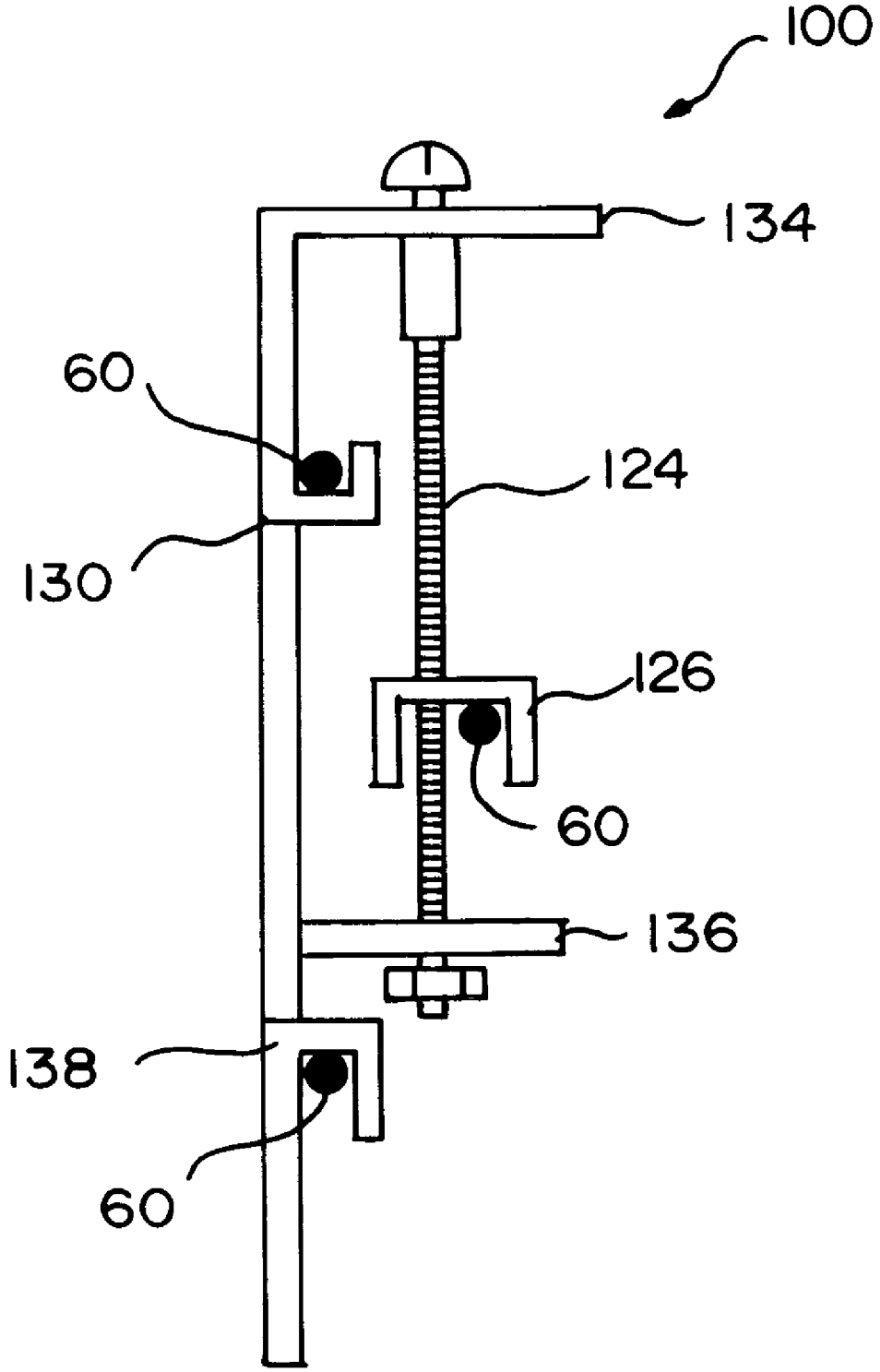
FIG. 2 is a side view of the frame support of FIG. 1 (the frame is not shown)

FIGS. 1 and 2 illustrate a first preferred frame support 100 according to the present invention. The frame support 100 comprises a plate 122, a screw 124, and an optional moveable adjusting hook 126.

The plate 122 comprises a set of upwardly directed cord supports 130, 132 located near a top of the plate, a top screw support 134, a bottom screw support 136, and one or more downwardly directed cord supports 138, 140 located near a bottom of the plate. Screw support holes 128 may be provided to enable the plate to be affixed to a wall. Washers 142, 144 are optionally provided to retain the support cord 60 in position if the frame is rotated to an orientation greater than about 180° from its original orientation. A spring 146 is optionally provided to couple ends of the support cord 60 and to provide tension to the cord, either in conjunction with the adjusting hook 126 or alone.

Figure 3:
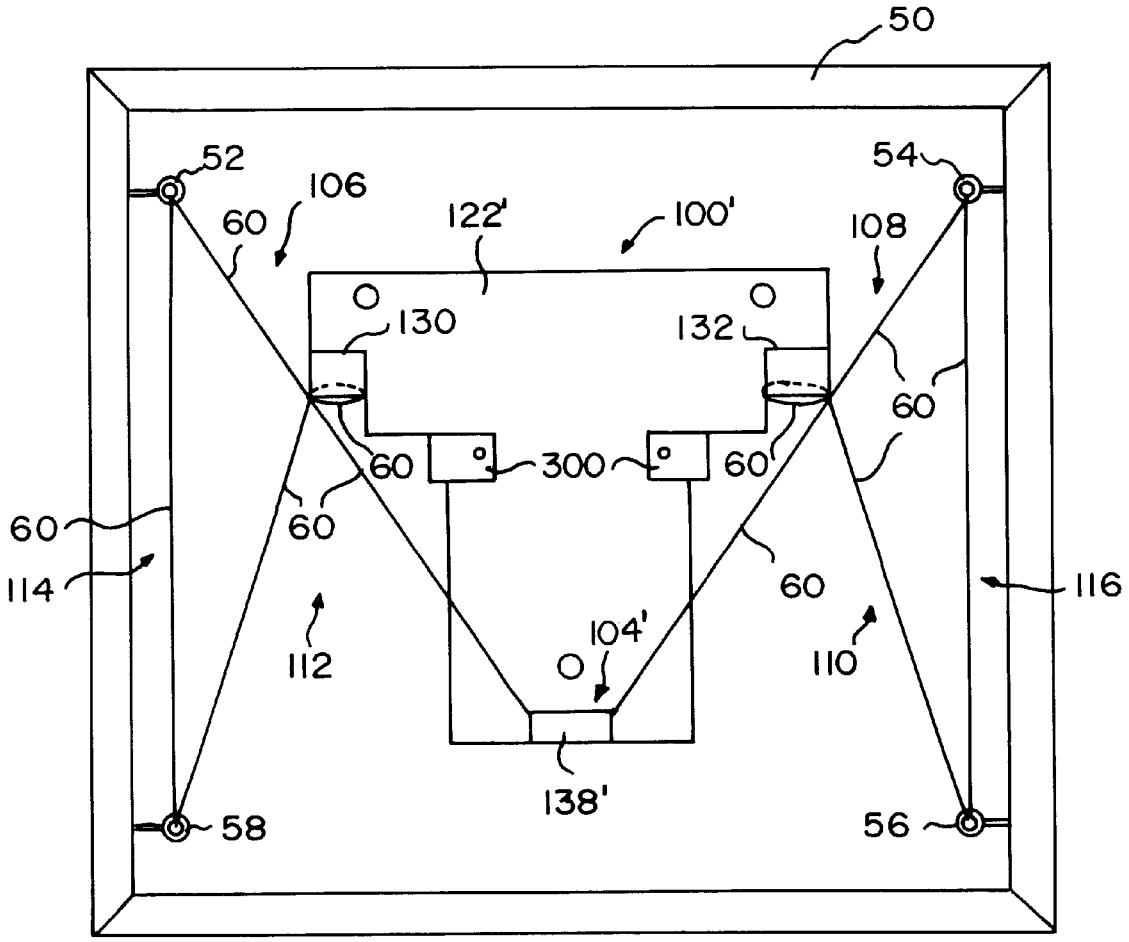
FIG. 3 is a front elevational view of a second embodiment of a frame support according to the present invention connected to a frame or object to be hung.
Figure 4:
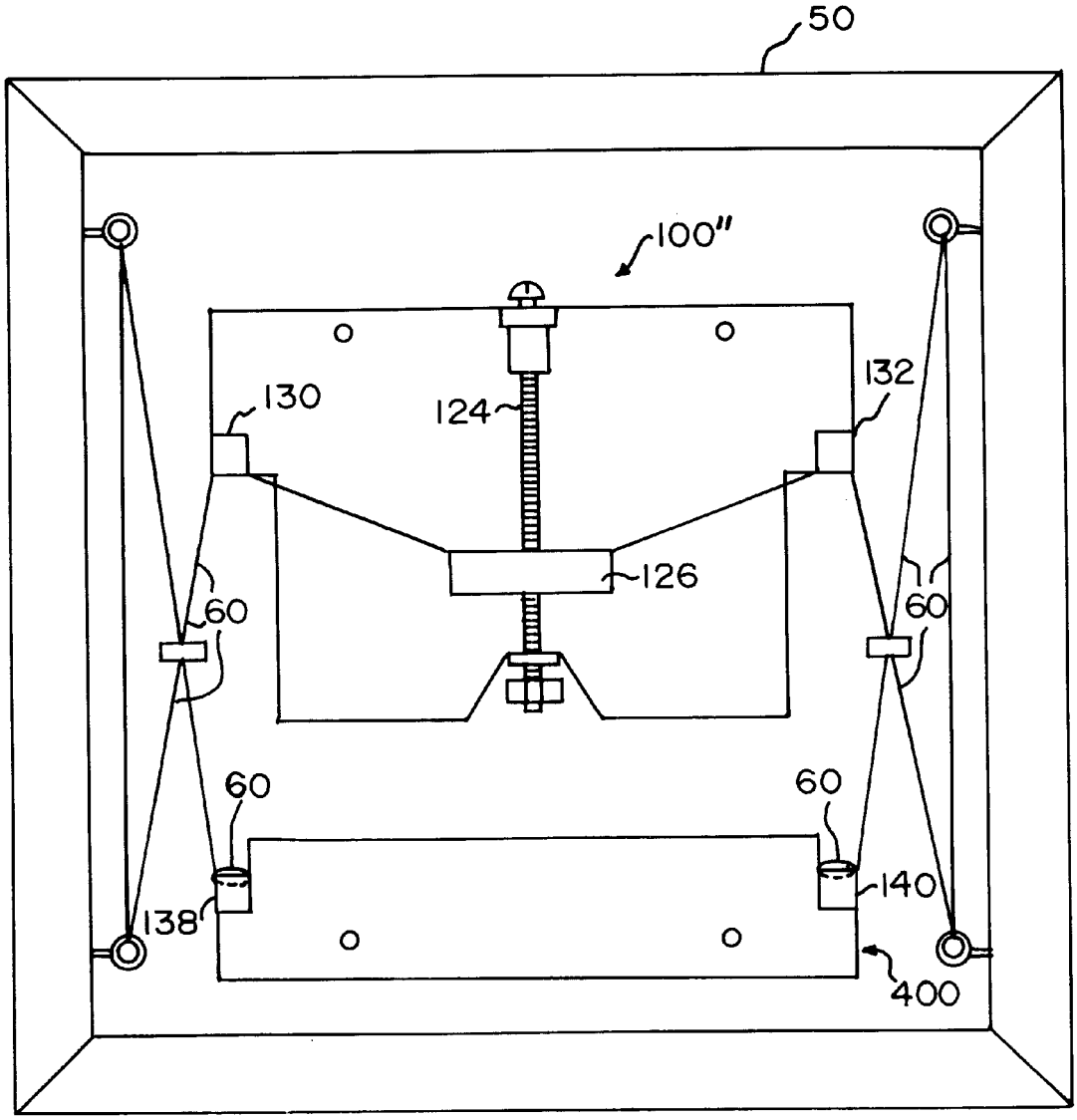
FIG. 4 is a front elevational view of a third embodiment of a frame support according to the present invention.

Note that the screw 124 and moveable adjusting hook 126 are optional, but preferred, structures. FIG. 3 illustrates a minimum structure for a preferred operative embodiment of the frame support 100'. This embodiment includes a plate 122' having two top cord supports 130, 132 and a single bottom cord support 138'. A single bottom support may be less stable than a frame support having two bottom supports. Note that the support cord is threaded through the support points 52–58 and frame support 100' in the same manner as shown in FIG. 1, with two exceptions. First, location 104' may be a single point. Second, instead of a continuous loop, the cord 60 is fixedly connected to the top cord supports 130, 132. The cord may alternatively be fixedly connected to the bottom cord support or supports, as seen in FIG. 4. The cord is preferably tightened before hanging the object on the wall. Any device or method for tightening the cord is sufficient. This embodiment may be connected to a wall, for example, by sliding it onto a pre-hung bracket or brackets 300.

The manner in which the support cord 60 is connected to the frame 50 and frame support 100 (100') is advantageous in providing the adjustable up and down, side to side, and rotational orientation according to the present invention. Referring to FIGS. 1 and 3, a preferred embodiment of the inventive frame support 100 is connected to the support cord 60 in a unique manner to achieve the advantages of the invention. First, the support cord 60 extends from a first top cord support 130 (to which it may be fixedly connected as in FIG. 3) to first side, bottom support point (eyelet 58). The support cord 60 then extends to the first side, top support point (eyelet 52) on the frame. Next, the cord extends to a bottom cord support 138 (or 138') on the device and optionally across the frame support 100 to an adjacent bottom cord support 140 (as seen in FIG. 1) on the device. Next, the cord 60 extends up to a second side, top support point (eyelet 54) on the frame. Next, the support cord 60 extends down to a second side, bottom support point (eyelet 56) on the frame, then up to a second side, top cord support 132 on the device. As seen in FIG. 3, the cord 60 may be fixedly connected to the second side, top cord support 132. Alternatively, the support cord 60 extends across the frame support 100 to the adjacent top cord support 130 as seen in FIG. 1. Optionally, the support cord 60 extends through the adjustable hook 126 located between the top cord supports 130, 132, as seen in FIG. 1. In FIG. 1, the cord is not fixedly connected to any of the frame support points, cord supports, or optional adjusting hook.

As seen in FIG. 1, the support cord 60 may include a spring 146, which provides tension on the support cord 60. The spring 146 can be used instead of the adjusting hook to provide tension on the cord or provide a limiting on the tension on the cord when used with the adjusting hook. The location of the spring 146 may place limitations on the adjustability of the frame either up and down, side to side, or rotationally. In FIG. 1, the spring is located between two support points (52, 58). This may limit rotational adjustability.

FIG. 4 illustrates a third embodiment 100" of the invention. In this embodiment, two bottom support hooks 138, 140 are maintained on a second, separate piece 400. This second piece 400 may preferably be attached to the wall prior to hanging the frame to be supported. Also, in FIG. 4, the cord is fixedly connected to the two bottom cord supports 138, 140.

Figure 5:
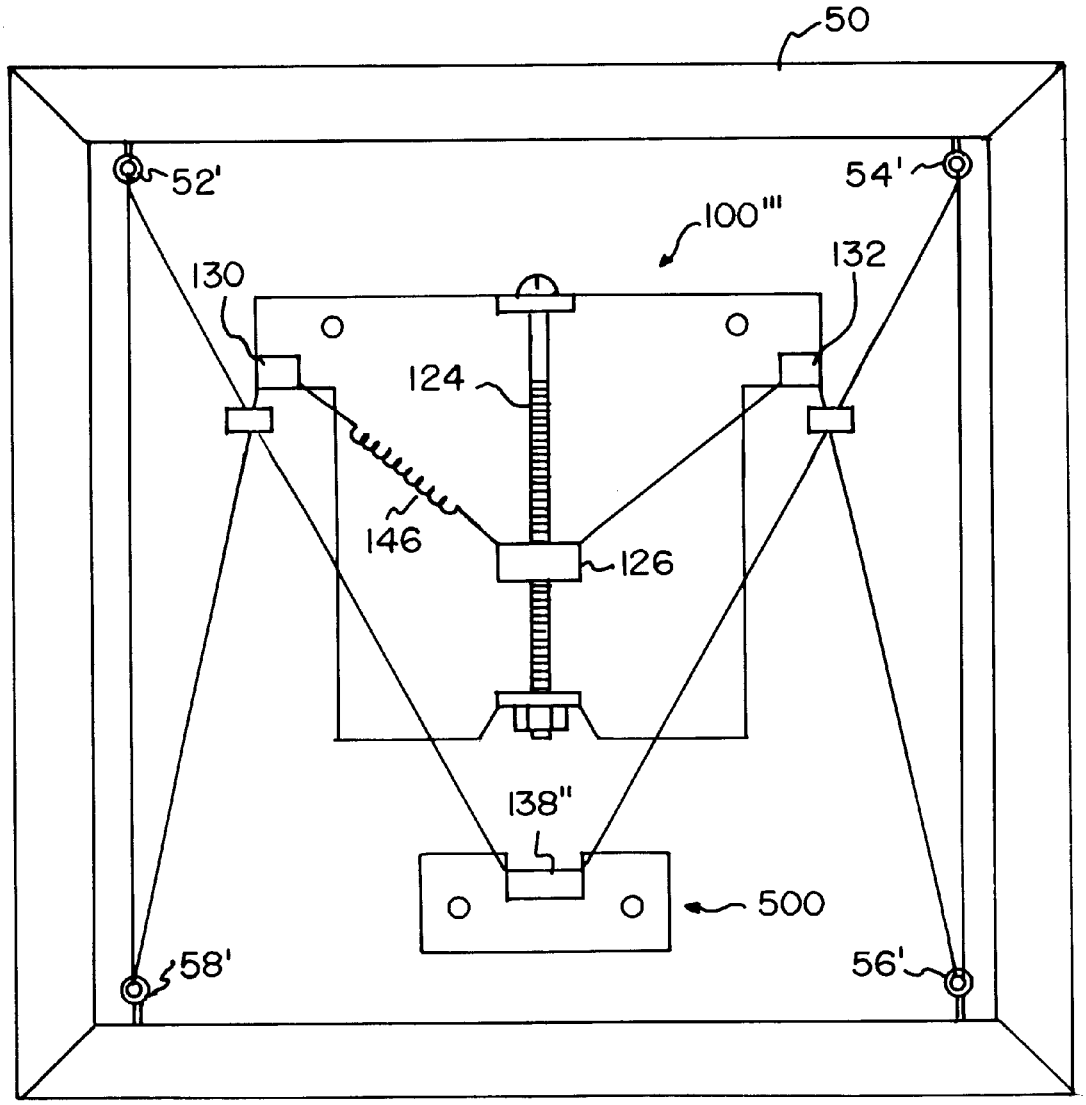
FIG. 5 is a front elevational view of a fourth embodiment of a frame support according to the present invention.

FIG. 5 illustrates a fourth embodiment 100'" of the invention. In this embodiment, a single bottom 138" support hook is maintained on a second, separate piece 500. This second piece 500 may preferably be attached to the wall prior to hanging the frame to be supported. Note that in this embodiment, the frame supports 52–58 are connected to the top and bottom of the frame 50. This may be preferable in certain circumstances. The tension of the cord 60 may cause the supports to bend. This may be avoided by using sturdy supports or, alternatively, by locating the supports 52', 54', 56', 58' in the top and bottom of the frame so that the tensioning forces pull on the frame and not on the supports. In FIG. 5, the spring 146 is located between the first side, top cord support 130 and the adjusting hook 126. This may limit side to side adjustability.

Method for Hanging A Frame Using the Improved Frame Support

The frame support 100 preferably operates as follows. Referring again to FIG. 1, the frame support 100 is connected to the support cord 60 as described above and illustrated in the figures.

The frame support 100 may then be affixed to a desired location on a wall. In a preferred embodiment (seen in FIG. 1), this location need not be precisely measured for height. Optionally, the moveable adjusting hook 126 may be moved to apply tension to the support cord 60 between the two top cord supports 130, 132, thus providing stable locations for the supported frame. The adjusting hook 126 may also raise and lower the frame 50, as described in U.S. patent application Ser. No. 08/630,878.

Figure 6A:
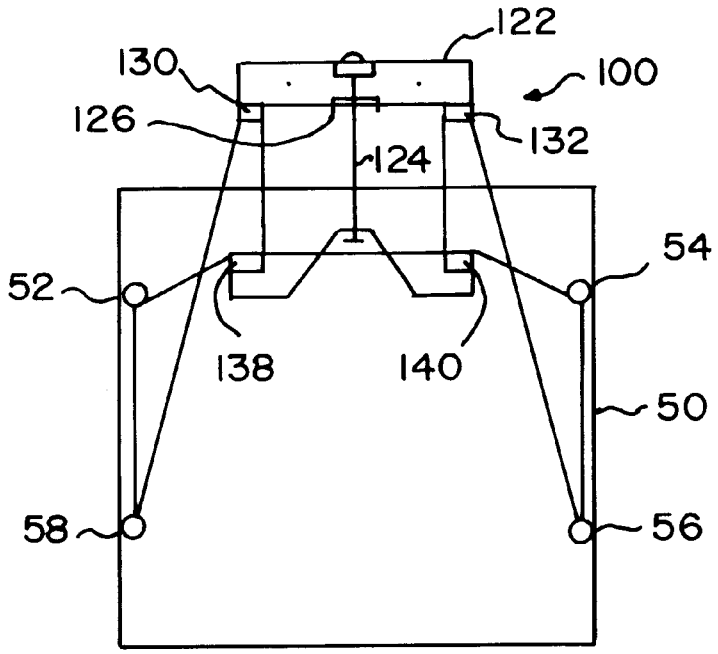
FIGS. 6A and 6B illustrate a method for hanging a frame using the inventive frame support.
Figure 6B:
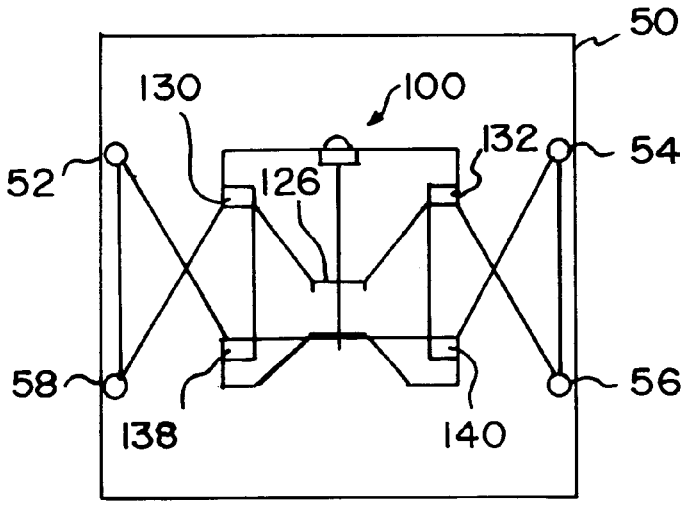

FIGS. 6A and 6B illustrate a preferred method for hanging a frame 50 using the inventive frame support. As seen in FIG. 6A, the length of support cord 60 is selected to be sufficiently long to extend above the top of frame 50 when pulled up. This provides a full view of the frame support 100 and allows the support cord 60 to be easily placed in the cord supports 130, 132, 138, 140. This also provides sufficient slack so that the frame may easily be pulled away from the wall. When selecting a length for the support cord 60, it may be preferable to attach the support cord to frame 50, and then run the cord 60 through the inventive frame support.

The support cord 60 and frame support 100 are then pushed above the top of the frame 50 in a position similar to 6A. The length of the support cord 60 is selected so that when the inventive frame support is adjusted, the frame support 100 is hidden behind the frame, as seen in FIG. 6B. Thus, as seen in FIG. 6A, the plate 100 may be affixed to a wall in a manner that the frame 50 hangs below the top of the plate 122.

As seen in FIG. 6B, the frame 50 may then be raised by turning the screw 124 until the frame 50 is at a desired height and the frame support 100 is hidden behind the frame. Once in position, the frame may be moved up and down, side to side, or rotated to any desired orientation. Thus, even if the support points are located on the sides of a rectangular frame, the frame may be securely placed in any desired orientation, such as diamond shaped.

Adjusting the Location of a Frame Supported With the Improved Frame Support

Figure 7:
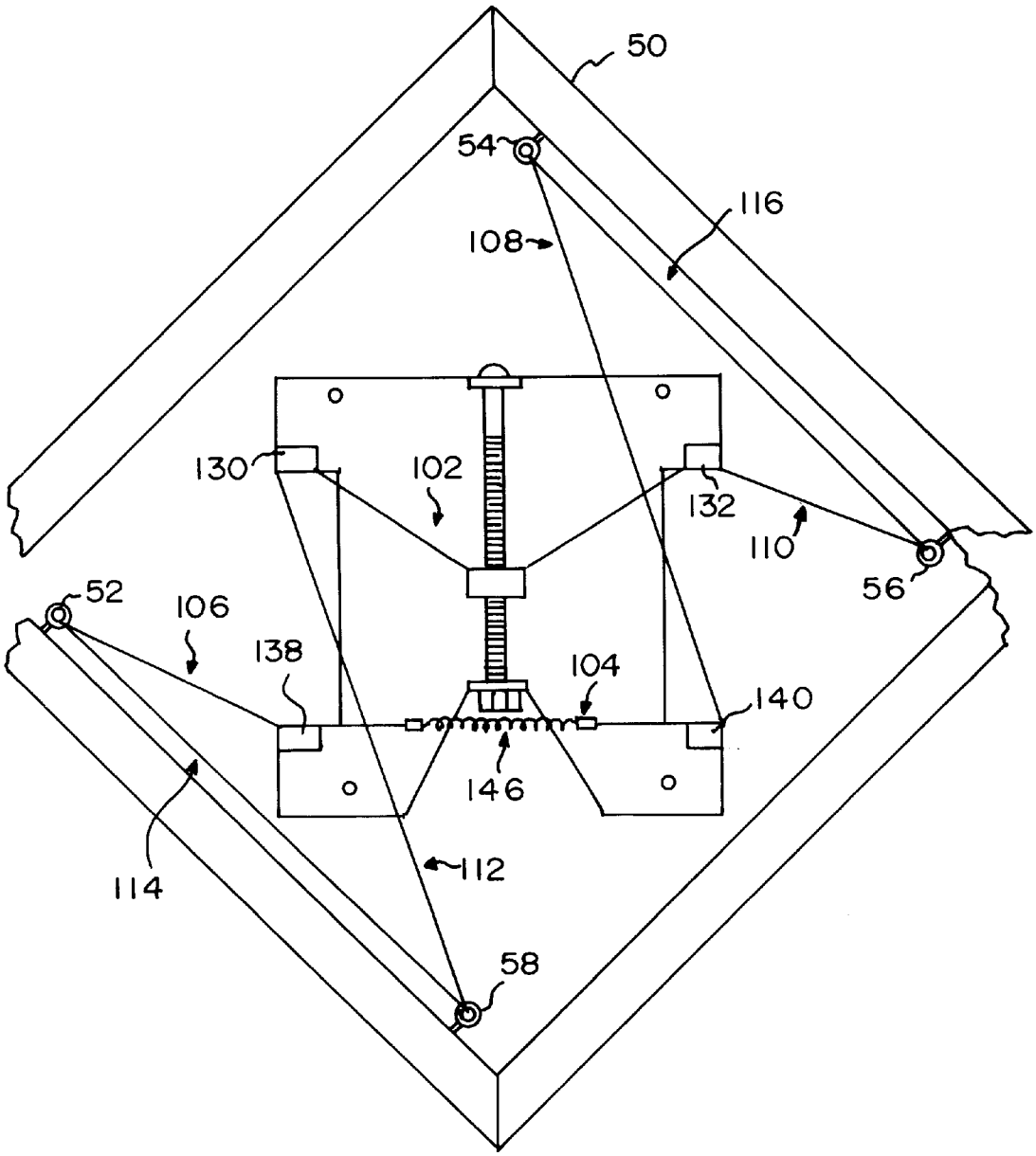
FIG. 7 shows the frame and frame support of FIG. 1 maintained in a diamond-shaped orientation.

FIG. 7 illustrates the frame 50 and frame support 100 of FIG. 1 rotated 90° to provide a diamond-shaped orientation. (Note, however, that the spring 146 is located between the first and second bottom cord supports 138, 140.) As indicated above, the length of the support cord 60 extending through frame support 100 (see locations 102, 104) and between the support points (between eyelets 52, 52—location 114—and between eyelets 54, 56—location 116) remain constant. The length of support cord 60 extending between the support points (52–58) and the cord supports (130, 132, 138, 140) vary with respect to each other.

Referring back to FIG. 1, when the hanger is centered on the frame, assume the distance between each support point (52–58) and its respective cord support (130, 132, 138, 140) is 7" (106–112), for a total length of 14" on each side of the frame, and 28" total between the support points and cord supports.

In FIG. 7, however, the changed orientation alters these lengths (but not the overall 28" measurement). In FIG. 7, the lengths may be:

| | |
|---|---|
| length 106 | 4.75" |
| length 108 | 9.25" |
| length 110 | 4.75" |
| length 112 | 9.25" |

Note that on each side, the total length remains 14" and the overall remains 28". Because the support cord 60 is firmly held by the frame support 100, the frame is held tightly in the selected orientation. The maximum rotation permitted by the device occurs when the lengths on one side of the frame support approach 14" for one length (length 108 for example) and 0" for the other length (length 106 for example). As the lengths approach 14" and 0", however, the position becomes less stable. The washers 142, 144 seen in FIG. 1 are provided to limit the angle of rotation to prevent the supported frame from being rotated to an unstable position. Also, if the supported frame is rotated past 180°, the cord 60 may slip out of cord supports 138, 140. If this happens and if the frame is subsequently rotated back to its original position, the cord may not re-seat in the supports and become slack.

Up and down and side to side adjustability are provided in a similar manner. If, for example, the frame 50 in FIG. 1 is to be moved to the left in the figure, the frame is moved in the desired direction. The length of support cord on the right side decreases (because the support points 54, 56 move closer to the cord supports 132, 140) and the length of support cord on the left side increases (because the support points 52, 58 move further from the cord supports 130, 138). In this preferred embodiment, the maximum amount of side-to-side adjustability is related to the distance between the top cord supports 130, 132. If, for example, the frame 50 in FIG. 1 is moved up, the length between top support points 52, 54 and bottom cord supports 138, 140 will increase, and the length between bottom support points 56, 58 and top cord supports 130, 132 will decrease. In this preferred embodiment, the maximum length of up and down adjustability is related to the distance between the top cord supports 130, 132 and the bottom cord supports 138, 140.

Improved Security Device for Adjustable Frame Hangers

The present invention also includes an improved security measure for the height adjustable frame support disclosed in FIG. 1 and the improved picture hanger disclosed in U.S. patent application Ser. No. 08/630,878. FIG. 8 discloses the security measure in a simple form.

Figure 8A:
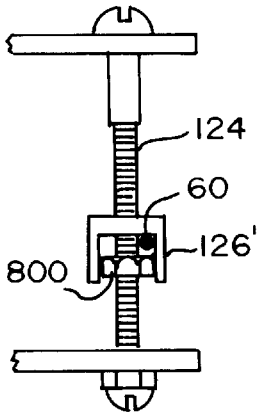
FIG. 8A is a partial cutaway view of an improved frame support having a first embodiment of a security device according to the present invention.

As seen in FIG. 8A, a support cord 60 or wire is located in an adjusting hook 126'. The support cord 60 or wire is then "locked" into position using a nut 800. By locking the cord or wire into position, preferably after the frame has been adjusted to the desired height, side to side, and rotational position as described above, two advantages are obtained. First, the frame cannot be removed from the wall simply by lifting the frame off of the frame support. Second, if the cord or wire breaks or disconnects from one side of the frame, the frame will not fall to the ground. Rather, the frame will be held on one side because the support cord or wire is locked into position by the inventive device. (This second advantage is not realized in the inventive device discussed above having side to side and rotational adjustability when the support cord 60 is not fixedly connected to the frame as seen in FIG. 1.)

Figure 8B:
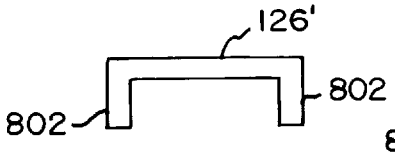
FIGS. 8B and 8C are a bottom view and a side view, respectively, of an adjusting hook for the security device of FIG. 8A.
Figure 8C:
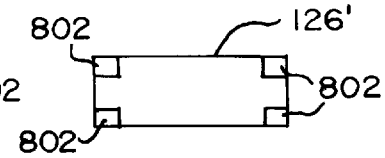
Figure 8D:
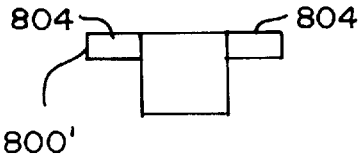
FIGS. 8D ad 8E are a bottom view and a side view, respectively, of a coupling nut for a security device according to a first embodiment of the invention.
Figure 8E:
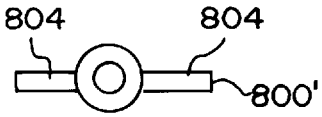
FIGS. 8F and 8G are a bottom view and a side view, respectively, of a coupling nut for a security device according to a second embodiment of the invention.
Figure 8F:
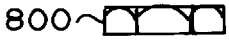
Figure 8G:
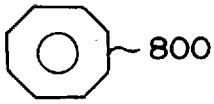

FIGS. 8A–8G illustrate several preferred embodiments of the security measure according to the present invention. As seen in FIGS. 8B and 8C, an adjusting hook 126' may be a hook nut, which is provided with four legs 802. These legs may be provided to mate with a connection nut 800' as seen in FIGS. 8D and 8E. The connection nut 800' has wings 804 which are configured to fit between the legs 802 of the hook nut adjusting screw 126'. FIGS. 8F and 8G illustrate a conventional nut 800, as seen in FIG. 8A.

Figure 9A:
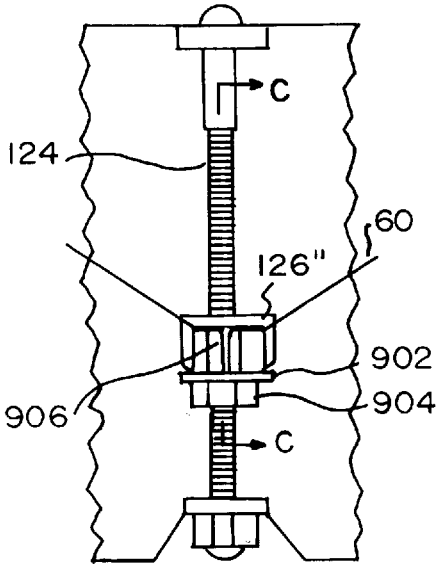
FIG. 9A is a partial cutaway view of a third embodiment of an improved frame support according to the present invention.
Figure 9B:
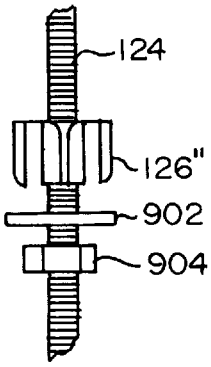
FIG. 9B shows the components of FIG. 9A separated from each other.
Figure 9C:
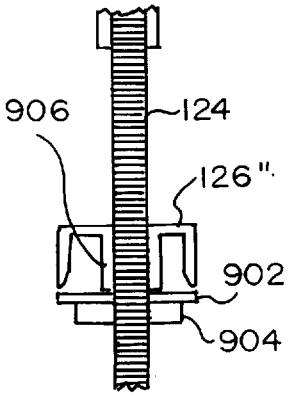
FIG. 9C is a cross-sectional view of the device of FIG. 9 taken along lines C—C.

FIGS. 9A–9C illustrate another preferred embodiment 900 of the security measure according to the present invention. As seen in FIG. 9A, a support cord 60 is located in an adjusting hook 126" which is a commercially available t-nut. The support cord 60 is then "locked" into position using a washer 902 and a nut 904. By locking the cord into position, preferably after the frame has been adjusted to the desired height, side to side, and rotational position as described above, two advantages are obtained. First, the frame cannot be removed from the wall simply by lifting the frame off of the frame support. Second, the t-nut 126" has a central portion, or sheath, 906 which covers the screw 124 and which prevents the screw threads from contacting the support cord 60. This protects the support cord 60 from becoming frayed by being "sawed" through by the screw 124.

Figure 10:
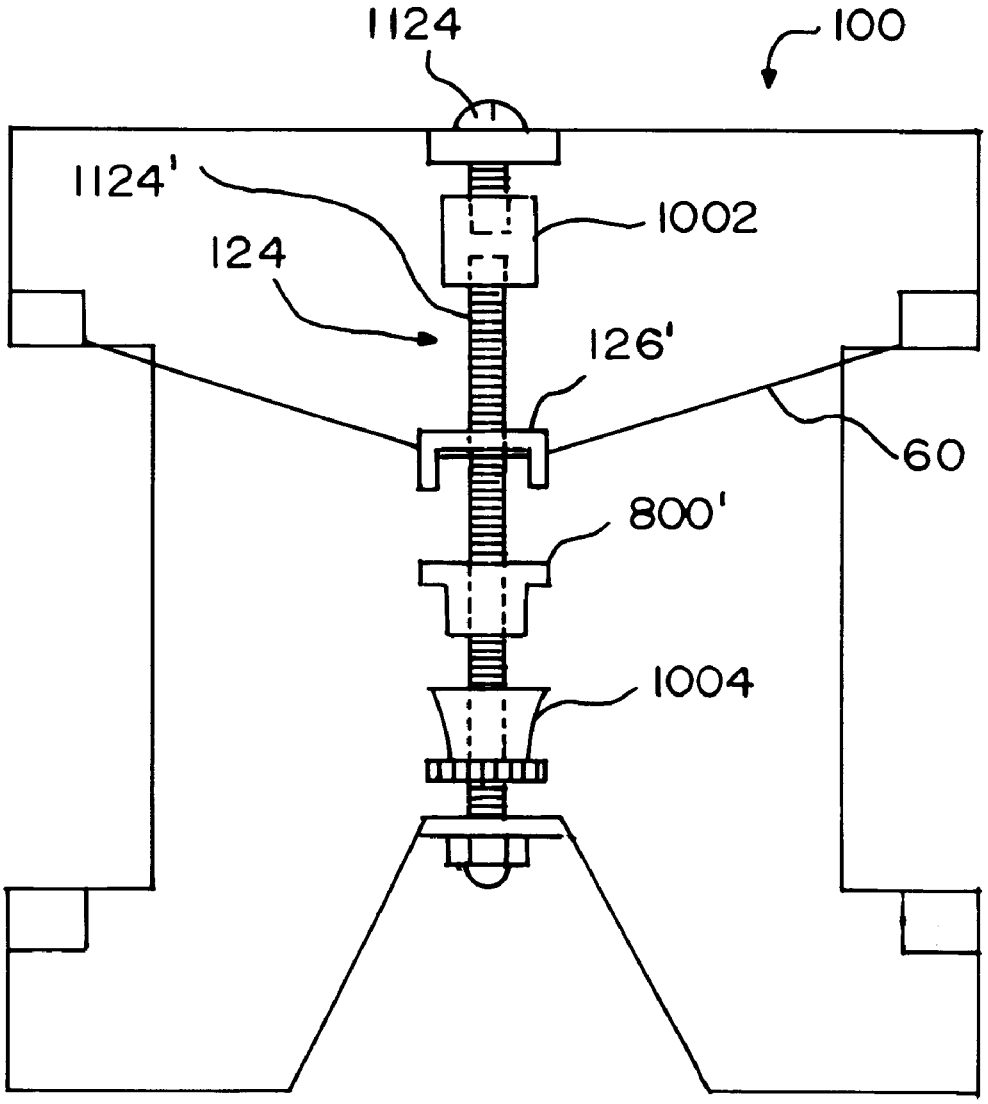
FIG. 10 shows a fourth embodiment of an improved frame support according to the present invention.

FIG. 10 is another preferred embodiment of the security measure according to the present invention. As seen in FIG. 10, a frame support 100 has a screw 124 which, as discussed below, comprises a first screw 1124 and a second screw 1124' joined by a union 1002. The security measure also includes an adjusting hook 126', which may be a hook nut, t-nut, or other suitable structure, and a nut 800', such as a conventional nut (as seen in FIGS. 8F and 8G) or connection nut (as seen in FIGS. 8D and 8E). When the first screw 1124 is turned, the union 1002 turns the second screw 1124' as well, thus raising or lowering the adjusting hook 126' accordingly. Once the adjusting hook 126 is in the desired position, the nut 800' may be screwed into position using a thumb nut 1004. Preferably, a user may pull the frame away from the wall and tighten the thumb nut 1004 with a thumb and forefinger to put the nut 800' in the proper position, thus locking the support cord 60 or wire into place in the adjusting hook.

Each of the embodiments described may be made of any suitably rigid material. Sheet metal, aluminum, brass, or other metals are preferred because they are inexpensive, sturdy, and the frame support and security device described may be stamped out of a metal sheet. Other materials are also possible. For example, the frame support and security device may be made of injection molded plastic, wood, or other suitable material.

The above described embodiments of the invention are intended to be illustrative only. Numerous alternative embodiments may be devised by those skilled in the art without departing from the spirit and scope of the following claims.

I claim:

1. An adjustable frame support, comprising:

a. a frame support device having:

(1) first and second cord supports directed in a first direction;

(2) a third cord support directed in a second, opposite direction facing away from the first direction;

b. a plurality of frame support points connectable to a frame, including:

(1) a first frame support point connectable to a first side of the frame further from the third cord support in the first direction than the first cord support;

(2) a second frame support point connectable to a second side of the frame further from the second cord support in the first direction than the second cord support;

(3) a third frame support point connectable to a first side of the frame further from the first cord support in the second direction than the third cord support; and (4) a fourth frame support point connectable to a second side of the frame further from the second cord support in the second direction than the third cord support; and c. a cord configured to be supported by the first, second, and third cord supports and first, second, third, and fourth frame support points in a manner that a length of cord extending between each of the frame support points and an associated cord support is variable.

2. The adjustable frame support of claim 1, wherein the cord is configured to be connected:

a. from the first cord support to the third frame support point;

b. from the third frame support point to the first frame support point;

c. from the first frame support point to the third cord support;

d. from the third cord support to the second frame support point;

e. from the second frame support point to the fourth frame support point; and f. from the fourth frame support point to the second cord support.

3. The adjustable frame support of claim 1, wherein the cord is further configured to extend from the second cord support to the first cord support.

4. The adjustable frame support of claim 1, further comprising a means for tensioning the cord.

5. The adjustable frame support of claim 4, wherein the means for tensioning the cord is a spring.

6. The adjustable frame support of claim 3, further comprising an adjusting hook movably connected between the first and second cord supports and configured to receive the cord.

7. The adjustable frame support of claim 6, wherein the cord is further configured to be connected from the second cord support, through the movable adjusting hook, and from the movable adjusting hook to the first cord support.

8. The adjustable frame support of claim 1, wherein the frame support device further comprises a plate having the first and second cord supports located near a top edge of the plate and facing upwards and the third cord support located near a bottom edge of the plate and facing downwards.

9. The adjustable frame support of claim 1, further comprising a fourth cord support directed in the second direction.

10. The adjustable frame support of claim 9, wherein the cord is configured to be connected:

a. from the fours cord support to second frame support point;

b. from the second frame support point to the fourth frame support point;

c. from the fourth frame support point to the second cord support;

d. from the second cord support to the first cord support;

e. from the first cord support to the third frame support point;

f. from the third frame support point to the first frame support point; and g. from the first frame support point to the third cord support.

11. The adjustable frame support of claim 10, wherein the cord is further configured to extend from the third cord support to the fourth cord support.

12. The adjustable frame support of claim 1, further comprising at least one washer connected to the cord and configured to limit rotation of the frame.

13. The adjustable frame support of claim 1, further including a frame and wherein the first and third frame support points are connected to a left side of the frame and the second and fourth frame support points are connected to a right side of the frame.

14. The adjustable frame support of claim 1, further including a frame and wherein the first and second frame support points are connected to a top of the frame and the third and fourth frame support points are connected to a bottom of the frame.

15. The adjustable frame support of claim 1, further including a frame and wherein the first, second, third, and fourth frame support points are connected to sides of a frame.

16. The adjustable frame support of claim 1, further including a frame and wherein the frame support device further comprises a plurality of plates, each plate having at least one of the first, second, and third cord supports.

17. A method for hanging an object using a support device having a plurality of cord supports, comprising the steps of:

a. movably connecting a cord to a frame at a plurality of support points connected on the object;

b. connecting the support device to the cord in a manner that a length of cord extending between each of the support points connected on the object and an associated cord support is variable; and c. affixing the support device to a wall.

18. The method of claim 17, further comprising after affixing the support device to a wall, tensioning the cord.

19. The method of claim 18, wherein the step of tensioning further comprises the step of providing a spring on the cord.

20. The method of claim 18, wherein the step of tensioning further comprises the step of moving an adjusting hook connected to the support device and the cord.

21. A method for hanging an object using a support device having a plurality of cord supports, comprising the steps of:

a. providing first and second cord supports directed in a first direction; and b. providing a third cord support directed in a second, opposite direction facing away from the first direction;

c. providing a first frame support point located on a first side of the frame further from the third cord support in the first direction than a first cord support; a second frame support point located on a second side of the frame further from the second cord support in the first direction than a second cord support;

d. providing a third frame support point located on a first side of the frame further from the first cord support in the second direction than the third cord support; and e. providing a fourth frame support point located on a second side of the frame further from the second cord support in the second direction than the third cord support;

f. movably connecting a cord to a frame at a plurality of support points on the object by:

i. connecting the cord from the first cord support to the third frame support point;

ii. connecting the cord from the third frame support point to the first frame support point;

iii. connecting the cord from a first frame support point to the third cord support;

iv. connecting the cord from the third cord support to the second frame support point;

v. connecting the cord from the second frame support point to the fourth frame support point;

vi. connecting the cord from the fourth frame support point to the second cord support;

g. connecting the support device to the cord in a manner that a length of cord extending between each of the support points and an associated cord support is variable; and h. affixing the support device to a wall.

22. The method of claim 21, wherein the method further comprises the step of connecting the cord from the second cord support to the first cord support.

23. The method of claim 21, further comprising the steps of:

a. providing a fourth cord support directed in the second direction; and b. wherein the step of connecting further comprises connecting the cord further comprises connecting the cord:

i. from the fourth cord support to second frame support point;

ii. from the second frame support point to the fourth frame support point;

iii. from the fourth frame support point to the second cord support;

iv. from the second cord support to the first cord support;

v. from the first cord support to the third frame support point;

vi. from the third frame support point to the first frame support point; and vii. from the first frame support point to the third cord support.

24. The method of claim 23, wherein the step of connecting further comprises connecting the cord from the third cord support to the fourth cord support.

25. A security device for an object support, comprising:

a. an adjusting hook configured to receive a support wire or cord; and b. a locking mechanism configured to contact the adjusting hook in a manner to lock the support wire or cord on the adjusting hook;

wherein the adjusting hook is meshed with a screw, the security device further comprising a sheath covering threads of the screw between the adjusting hook and the locking mechanism.

26. A security device for an object support, comprising:

a. an adjusting hook configured to receive a support wire or cord; and b. a locking mechanism configured to lock the support wire or cord on the adjusting hook;

wherein the adjusting hook is a hook nut and the locking mechanism is configured to mate with the hook nut.

27. A security device for an object support, comprising:

a. an adjusting hook configured to receive a support wire or cord; and b. a locking mechanism configured to lock the support wire or cord on the adjusting hook;

wherein the adjusting hook is a t-nut and the locking mechanism is a washer and a nut.

28. A security device for an object support, comprising:

a. an adjusting hook configured to receive a support wire or cord; and b. a locking mechanism configured to lock the support wire or cord on the adjusting hook;

wherein the adjusting hook is meshed with a first screw, further comprising a second screw connected to the first screw via a union and a thumb nut on the screw configured to connect the locking mechanism with adjusting hook.

* * * * *